US011414104B2

(12) United States Patent
Gageik et al.

(10) Patent No.: US 11,414,104 B2
(45) Date of Patent: Aug. 16, 2022

(54) CLADDING ARRANGEMENT FOR A VEHICLE

(71) Applicant: SIEMENS AG ÖSTERREICH, Vienna (AT)

(72) Inventors: Manuel Alexander Gageik, Mülheim an der Ruhr (DE); Andreas Grzona, Straelen (DE); Martin Krause, Rheinberg (DE); Thomas Moshammer, Graz (AT); Alexander Prix, Graz (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 398 days.

(21) Appl. No.: 16/446,821

(22) Filed: Jun. 20, 2019

(65) Prior Publication Data

US 2019/0389493 A1 Dec. 26, 2019

(30) Foreign Application Priority Data

Jun. 22, 2018 (AT) ..... A50519/2018

(51) Int. Cl.

| | |
|---|---|
| ***B61D 17/00*** | (2006.01) |
| ***B61D 27/00*** | (2006.01) |
| ***B61F 5/52*** | (2006.01) |
| *B61F 19/02* | (2006.01) |

(52) U.S. Cl.

CPC ..... *B61D 27/0045* (2013.01); *B61D 17/00* (2013.01); *B61D 27/0036* (2013.01); *B61F 5/52* (2013.01); *B61F 19/02* (2013.01)

(58) Field of Classification Search

CPC ..... B60S 1/026; B61D 17/00; B61D 17/02; B61D 27/0036; B61D 27/0045; B61F 5/52; B61F 19/02; Y02T 30/00

See application file for complete search history.

(56) References Cited

U.S. PATENT DOCUMENTS 4,967,056 A * 10/1990 Iwasa ..... B60S 1/026 219/203
5,285,047 A * 2/1994 Petrelli ..... B61D 27/0036 219/202
2012/0217232 A1 8/2012 Hermann et al.

(Continued)

FOREIGN PATENT DOCUMENTS

| | | |
|---|---|---|
| DE | 10015158 | 10/2001 |
| DE | 102009052535 | 5/2011 |
| DE | 102010000957 | 7/2011 |

(Continued)

OTHER PUBLICATIONS

Office Action dated Dec. 22, 2020 issued in Canadian Patent Application No. 3,044,215.

*Primary Examiner* — Zachary L Kuhfuss
(74) *Attorney, Agent, or Firm* — Cozen O'Connor

(57) ABSTRACT

A cladding arrangement includes at least one first cladding part for a vehicle, in particular a rail vehicle, which is connectable via at least one connecting device to a running gear of the vehicle, a running gear component, a car body of the vehicle or a car body component, wherein at least one first heating device, which is directed into a hollow formed by at least the first cladding part, is connected to the at least first cladding part to provide advantageous structural conditions such that ice deposits on the vehicle may be effectively thawed.

17 Claims, 1 Drawing Sheet

(56) References Cited

U.S. PATENT DOCUMENTS

2018/0339569 A1 11/2018 TenEycke et al.

FOREIGN PATENT DOCUMENTS

| | | | | | |
|---|---|---|---|---|---|
| DE | 202012101314 | U1 * | 8/2012 | ..... | B61D 17/00 |
| DE | 202012101314 | | 9/2012 | | |
| DE | 102011121933 | | 1/2013 | | |
| DE | 102012004136 | | 8/2013 | | |
| DE | 102014212623 | | 12/2015 | | |
| DE | 102014215658 | | 2/2016 | | |
| DE | 102014215658 | A1 * | 2/2016 | ..... | B61F 99/00 |
| DE | 102015220253 | | 4/2017 | | |
| JP | 2018058434 | | 4/2018 | | |
| JP | 2018058434 | A * | 4/2018 | | |
| RU | 102340 | U | 2/2011 | | |
| WO | WO 2010/133308 | | 11/2010 | | |
| WO | WO2014/206643 | | 12/2014 | | |

* cited by examiner

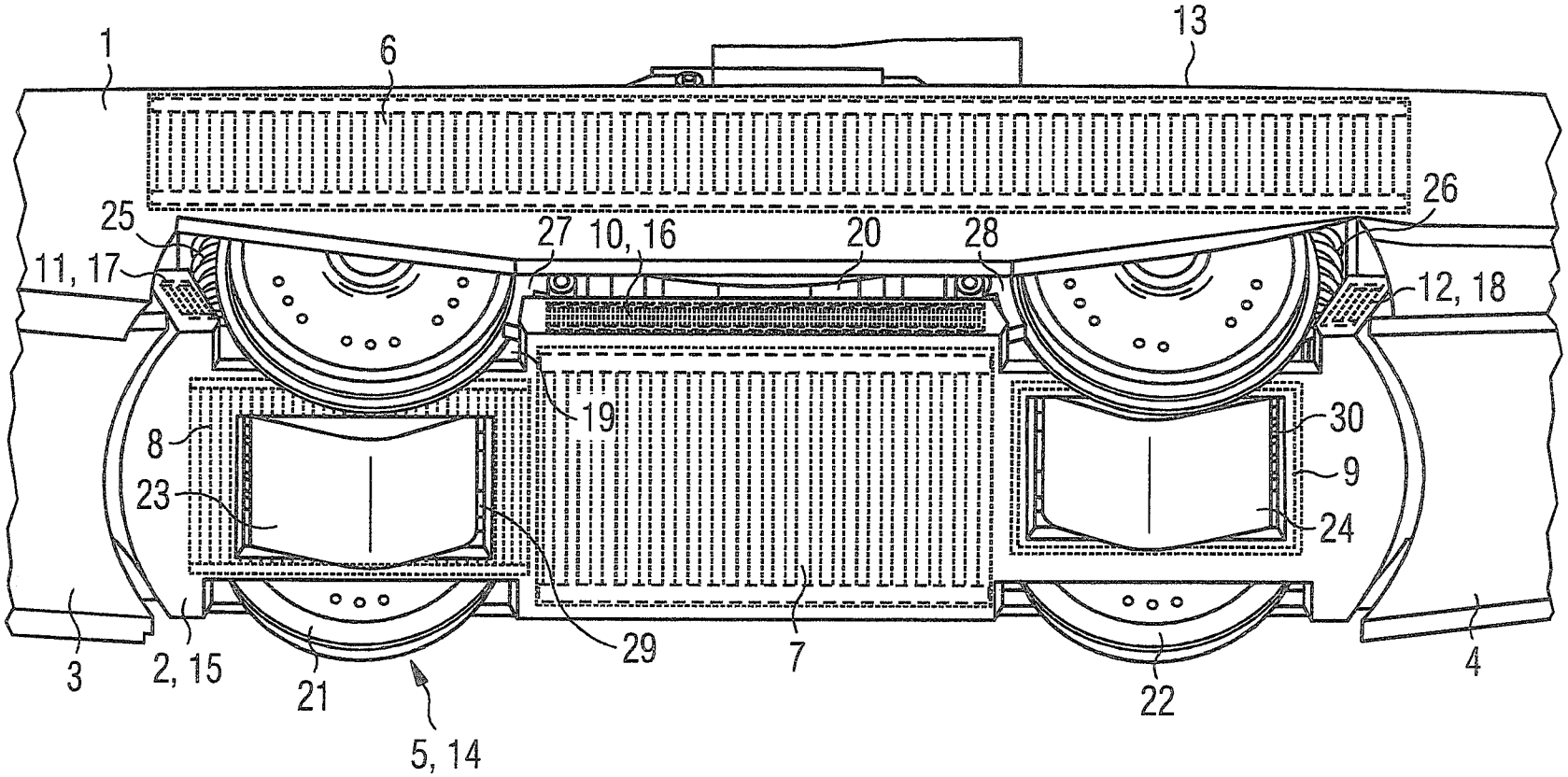
1
6
13
26
12, 18
4
30
9
24
22
28
20
7
10, 16
27
19
29
5, 14
21
25
11, 17
8
23
2, 15
3

CLADDING ARRANGEMENT FOR A VEHICLE

BACKGROUND OF THE INVENTION

1. Field of the Invention

The invention relates to a cladding arrangement having at least one first cladding part for a vehicle, in particular a rail vehicle, which is connectable via at least one connecting device to a running gear of the vehicle, a running gear component, a car body of the vehicle or a car body component.

2. Description of the Related Art

To achieve low air resistance, vehicles, running gear, roofs or roof structures of vehicles, such as rail vehicles, trucks and/or roofs of rail vehicles, frequently have aerodynamically shaped cladding. Low air resistance is important for keeping energy requirements or requirements with respect to vehicle drive power and/or fuel consumption as low as possible.

Furthermore, during winter operation of vehicles, it frequently occurs that snow and ice build-up on bodies and on running gear and/or within running gear (for example, on brake cylinders and brake calipers) and such snow and ice must generally be removed in highly heated de-icing halls provided for this purpose, to ensure functionality of the vehicles and the components thereof. Such de-icing or thawing operations are not only demanding in terms of time, energy and personnel but are also costly. Specific de-icing apparatuses have to be provided, the above-mentioned de-icing halls built and appropriately provided installations operated and maintained.

Prior art document WO 2014/206643 A1, for example, describes a clad running gear for a rail vehicle. Cladding side parts are arranged to the side of the running gear and/or along the rail vehicle. A base part is provided on a running gear underside. The side parts are connected to a car body of the rail vehicle, and the base part is connected to the running gear. A gap, which allows the wheels to turn out, is provided between the side elements and the base element.

In its known form, the stated conventional approach has the disadvantage that the cladding encourages snow and ice to become deposited on the running gear and the components thereof.

JP 2018-58434 A, which discloses a running gear of a rail vehicle with a heating device, is furthermore known. The heating device is arranged on an underside of a running gear frame. No running gear cladding is apparent, meaning high heat losses are probable and an effective heating action is only to be expected in the immediate vicinity of the heating device.

SUMMARY OF THE INVENTION

In view of the foregoing, it is therefore an object of the invention to provide a running gear cladding with an effective and efficient de-icing device combined therewith.

This and other objects and advantages are achieved in accordance with the invention with a cladding arrangement of the above-stated type, in which at least one first heating device, which is directed into a hollow formed by at least the first cladding part, is connected to the at least first cladding part. In this way, thawing and de-icing operations can be performed on-vehicle. De-icing halls that need major heating and stationary de-icing installations and/or apparatuses can be dispensed with.

If the cladding arrangement is arranged, for example, on the running gear, then the cladding arrangement forms a running gear hollow or running gear cavity. By directing the first heating device into this running gear hollow or running gear cavity, particularly effective and efficient heating of the running gear or of running gear components is achieved. Relatively minor heat losses and thus a moderate heating power requirement are to be expected. Thus, rapid and, in particular in comparison with de-icing using a hot-air stream, energy-efficient de-icing or thawing operations relating to snow and ice deposits are performed on the vehicle.

Damage, as may arise, for example, in the case of manual thawing operations using hot water from high-pressure cleaners or using tools for breaking off ice deposits on the vehicle, is avoided.

As a result of the cladding arrangement in accordance with the invention, the availability and flexibility of the vehicle is consequently also increased.

It is favorable for the at least first heating device to take the form of a film heater. This measure results in a particularly compact arrangement and thus low utilization of available structural space.

In an advantageous embodiment, the at least first heating device is connectable to a power distribution facility of the running gear. This measure means that cables do not have to be guided directly from the first heating device to a power supply unit in the vehicle and the cables needed for the first heating device may be short in construction.

In another favorable embodiment, the at least first heating device is adapted to the at least first cladding part with respect to the geometric shape thereof. As a result of this measure, the first heating device may, on the one hand, be positioned as close as possible to a vehicle component that needs heating, and the number of heating devices needed on the first cladding part may be reduced. If, for example, the first cladding part has a recess, then there is no need to arrange a plurality of heating devices around the recess, but rather merely the first heating device is required, which may, depending on application, have a recess congruent with the recess in the first cladding part.

It is favorable for the at least first heating device to have a temperature sensor. In this way, temperature information may be acquired at the first heating device and passed, for example, to a control unit for temperature adjustment of the first heating device or to a data memory for statistical evaluation, and the like.

In yet another advantageous embodiment, the at least first heating device is connectable to a control unit of the vehicle. This measure enables flexible setting of first heating device temperatures, which proceeds, for example, by predetermining a nominal value, which is input via an operator control unit with a display in the driver's cab of the vehicle.

In a further embodiment, the at least first heating device is connectable to a data bus of the vehicle. This enables data to be transmitted from and to the first heating device. For example, temperature data produced by the temperature sensor or current data may be transmitted to the control unit, to a data memory or further vehicle system (for example, diagnostic systems). Error states of the first heating device may thus be detected, for example, and warnings produced (for example, in the driver's cab).

It is favorable for the at least first heating device to be connectable to a radio device. This measure enables data, via which, for example an error state of the first heating device may be detected, to be transferred as radio signals to vehicle systems or maintenance stations having corresponding receive units.

In an advantageous embodiment, the at least first heating device is arranged in alignment with a vehicle component to be heated. This brings about effective heat transfer from the first heating device to the component to be heated.

In a further advantageous embodiment, the at least first heating device is arranged integrated into the at least first cladding part. This measure makes it possible to dispense with heating devices which are arranged on the first cladding part and that may become detached or fall off and are exposed to environmental conditions, and the like. Protective jacketing of the first heating device by the first cladding part itself is consequently achieved.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in greater detail below with reference to an exemplary embodiment, in which:

The FIGURE shows an exemplary embodiment of a cladding arrangement in accordance with the invention with heating devices in a perspective view from below and to the side, where the cladding arrangement is connected to a running gear and a car body of a rail vehicle.

DETAILED DESCRIPTION OF THE EXEMPLARY EMBODIMENTS

A portion illustrated in the FIGURE in a perspective view from below and to the side of an exemplary embodiment of a cladding arrangement in accordance with the invention has a first cladding part 1, a second cladding part 2, a third cladding part 3, a fourth cladding part 4 and a fifth cladding part (not shown), these being shaped in an aerodynamically favorable way.

The first cladding part 1 is arranged in the region of a first running gear longitudinal side 13 and bolted to a car body (not shown) of a rail vehicle. Bolts are provided as corresponding connecting devices.

The fifth cladding part is arranged in the region of a second running gear longitudinal side 14 and likewise bolted to the car body.

It is also feasible, in accordance with the invention, to provide hinges, i.e., articulated joints, as connecting devices between the first cladding part 1 and the car body and between the fifth cladding part and the car body, such that the first cladding part 1 and the fifth cladding part can fold open and shut. It is, moreover, conceivable to form the first cladding part 1 and the fifth cladding part as multipart components.

The second cladding part 2 takes the form of underbody cladding for running gear 5 of the rail vehicle and is coupled to a running gear frame 20, i.e., a running gear component, via wire rope dampers (not shown), which function as connecting devices between the second cladding part 2 and the running gear frame 20. The second cladding part 2 is formed in one piece. In accordance with the invention, it is however also possible to form the second cladding part 2 as a multipart component and to connect individual parts of the second cladding part 2 together in an articulated manner.

The third cladding part 3 and the fourth cladding part 4 are arranged below non-visible tanks connected to the car body, i.e., car body components, and bolted to these tanks. Between the second cladding part 2, on the one hand, and the third cladding part 3 and the fourth cladding part 4, on the other hand, two curved interspaces or gaps are provided, in order not to impede turning out of the running gear 5 and the second cladding part 2 relative to the car body or relative to the third cladding part 3 and the fourth cladding part 4.

The running gear 5 takes the form of an internally mounted running gear 5 and has a first wheel set 21 and a second wheel set 22, which are coupled to the running gear frame 20 via non-visible wheel set bearing devices. Between the first wheel set 21 and the second wheel set 22, on the one hand, and the first cladding part 1, the second cladding part 2 and the fifth cladding part, on the other hand, intervals or interspaces are provided so as not to restrict the mobility of the first wheel set 21 and of the second wheel set 22 relative to the cladding arrangement. Furthermore, the running gear 5 has a first drive unit 23 connected to the first wheel set 21 and a second drive unit 24 connected to the second wheel set 22.

In the region of the first running gear longitudinal side 13, a first primary spring 25 is arranged between the first wheel set 21 and the running gear frame 20, and a second primary spring 26 is provided between the second wheel set 22 and the running gear frame 20. In the region of the second running gear longitudinal side 14, there are provided a third, non-visible, primary spring arranged between the first wheel set 21 and the running gear frame 20 and a fourth, likewise non-visible, primary spring arranged between the second wheel set 22 and the running gear frame 20.

A first shoe brake 27 and a second shoe brake 28 are connected in the region of the first running gear longitudinal side 13 to the running gear frame 20, a third shoe brake and a fourth shoe brake, which are not visible, being connected in the region of the second running gear longitudinal side 14.

A first heating device 6 is connected to a first inner side of the first cladding part 1, and a second heating device 7, third heating device 8 and fourth heating device 9 are connected to a second inner side of a bottom face 15 of the second cladding part 2.

Furthermore, a fifth heating device 10 is connected to a third inner side of a first side face 16 of the second cladding part 2, a sixth heating device 11 is connected to a fourth inner side of a second side face 17 of the second cladding part 2 and a seventh heating device 12 is connected to a fifth inner side of a third side face 18 of the second cladding part 2. Further heating devices are connected to further inner sides of the fifth cladding part and further side faces of the second cladding part 2.

It is conceivable, in accordance with the invention, to also connect heating devices to inner sides of the third cladding part 3 and of the fourth cladding part 4 and thus to heat the tanks located thereabove.

The first heating device 6, the second heating device 7, the third heating device 8, the fourth heating device 9, the fifth heating device 10, the sixth heating device 11 and the seventh heating device 12 are formed as conventional film heaters, are provided on inner sides of the cladding arrangement and are directed into a running gear hollow 19 formed by the cladding arrangement, whereby this and chassis components such as the first shoe brake 27, the second shoe brake 28, the third shoe brake and/or the fourth shoe brake may be effectively heated and snow and ice deposits effectively thawed.

The film heaters are adhesively bonded to the cladding arrangement. In accordance with the invention, it is however also conceivable to clamp on the film heaters via clamping devices provided on the cladding arrangement or this to connect them via other force- or form-locking connections and/or material bonds to the cladding arrangement. It is, for example, conceivable for the film heaters to be arranged on supports or frames which are bolted to the cladding arrangement.

The film heaters used for the cladding arrangement in accordance with the invention are electric resistance heaters. These have a plurality of metallic panel heating elements which are sheathed in plastics films. The panel heating elements are connected via connection elements to terminals (not shown) to which cable lines (likewise not shown) are connected. These cable lines are connected to a non-visible power distribution facility, which is arranged on the running gear frame 20. The power distribution facility is connected, likewise via a cable line, to a power supply facility of the car body, via which the first heating device 6, the second heating device 7, the third heating device 8, the fourth heating device 9, the fifth heating device 10, the sixth heating device 11 and the seventh heating device 12 are supplied with electricity.

In accordance with the invention, it is also conceivable to connect the first heating device 6, the second heating device 7, the third heating device 8, the fourth heating device 9, the fifth heating device 10, the sixth heating device 11 and the seventh heating device 12 directly to the power supply facility.

In accordance with the invention, it is also conceivable to integrate the first heating device 6, the second heating device 7, the third heating device 8, the fourth heating device 9, the fifth heating device 10, the sixth heating device 11 and the seventh heating device 12 into the cladding arrangement. In this case, heating rods coated with electrically insulating layers are incorporated into the first cladding part 1, the second cladding part 2 and the fifth cladding part, i.e., enveloped in a material of the cladding arrangement, only those sides of the heating rods which face the running gear hollow 19 being exposed.

The power distribution facility has a control unit with a computing unit, which is connected via conduction paths for data transmission to the first heating device 6, the second heating device 7, the third heating device 8, the fourth heating device 9, the fifth heating device 10, the sixth heating device 11 and the seventh heating device 12, on the one hand, and to an operator control unit in a driver's cab of the car body, on the other hand. The control unit is supplied with electricity via the power distribution facility.

The first heating device 6, the second heating device 7, the third heating device 8, the fourth heating device 9, the fifth heating device 10, the sixth heating device 11 and the seventh heating device 12 each have a temperature sensor (not shown). The temperature sensors are connected to the control unit via stated conduction paths.

With the operator control unit in the driver's cab of the rail vehicle, the film heaters may be switched on and off and nominal temperatures set. On the basis of these nominal temperatures and the actual temperatures measured by the temperature sensors, the control unit generates control signals, via which electrical currents of the film heaters are adjusted in order to achieve and maintain a predetermined actual temperature.

In accordance with the invention, it is also conceivable to operate and control the first heating device 6, the second heating device 7, the third heating device 8, the fourth heating device 9, the fifth heating device 10, the sixth heating device 11 and the seventh heating device 12 separately.

The control unit has additionally includes an external temperature sensor (not shown). Automatic switching on and off of the film heaters is possible via corresponding external temperature data. If the external temperature falls below a defined first threshold value, then the film heaters are thus activated. If a defined second external temperature threshold value, which is greater than the first external temperature threshold value, is exceeded and the film heaters have been continuously activated over a defined period, the film heaters are deactivated.

The first heating device 6, the second heating device 7, the third heating device 8, the fourth heating device 9, the fifth heating device 10, the sixth heating device 11 and the seventh heating device 12 are furthermore connected via the control unit to a radio device arranged in the control unit, which radio device has a first antenna with a transmit and receive unit. Temperature and diagnostics data etc. of the film heaters are transferred via the radio device to a maintenance station or other recipient for evaluation. Furthermore, preset nominal temperatures may be transferred from a maintenance station to the radio device and consequently to the control unit and the film heater may thus be remotely controlled.

In accordance with the invention, it is also conceivable for the film heaters in each case to be connected directly to their own radio device. Here, it also possible to dispense with cable-based conduction paths for data transmission between the film heaters and the control unit and to perform a data exchange between the film heaters and the control unit via radio signals, the control unit to this end having its own, second antenna.

Furthermore, the first heating device 6, the second heating device 7, the third heating device 8, the fourth heating device 9, the fifth heating device 10, the sixth heating device 11 and the seventh heating device 12 are also connected via the control unit to a data bus (not shown) of the rail vehicle, via which, for example, temperature data and status data (for example, with respect to electrical current or resistance values of the film heaters) etc. may be transferred to a display unit in the driver's cab or to a diagnostics system of the rail vehicle, and the like. Furthermore, the control unit may also receive control signals etc. via the data bus.

In accordance with the invention, it is also possible for the first heating device 6, the second heating device 7, the third heating device 8, the fourth heating device 9, the fifth heating device 10, the sixth heating device 11 and the seventh heating device 12 to be connected separately via corresponding data lines to the data bus.

The fifth heating device 10 is provided in the immediate vicinity of the first shoe brake 27 and the second shoe brake 28, whereby these are effectively heatable, and ice deposits, which may lead to seizing of brake cylinders or brake levers, may be thawed.

In accordance with the invention, it is also conceivable to configure the fifth heating device 10 in two parts and for both parts to be arranged in alignment in each case with a vehicle component to be heated, i.e., for example, with the first shoe brake 27 and the second shoe brake 28.

The sixth heating device 11 is arranged in the immediate vicinity of the first primary spring 25, and the seventh heating device 12 is arranged in the immediate vicinity of the second primary spring 26. The first primary spring 25 and the second primary spring 26 may thus be effectively heated and ice deposits stuck thereto, which may immobilize the first primary spring 25 and the second primary spring 26, thawed.

The third heating device 8, the fourth heating device 9, the sixth heating device 11 and the seventh heating device 12 are formed to the cladding arrangement with respect to their geometric shapes. The third heating device 8 and the fourth heating device 9 have recesses which are congruent with a first recess 29 of the second cladding part 2, through which the first drive unit 23 projects, and a second recess 30 of the second cladding part 2, through which the second drive unit 24 projects, and thus form a frame around the first drive unit 23 and the second drive unit 24. The sixth heating device 11 and the seventh heating device 12 are parallelogram-shaped and thus fit geometrically with the second side face 17 and the third side face 18 of the second cladding part 2.

The second heating device 7 and the fifth heating device 10 are separate from one another. However, in accordance with the invention it is also possible to form the second heating device 7 and the fifth heating device 10 as a single unit, this single unit having a rebate in a transitional zone between the bottom face 15 and the first side face 16 of the second cladding part 2.

In accordance with the invention, it is moreover conceivable for the cladding arrangement to cover not only underframe components (for example, the tanks) and running gear 5, but also vehicle roof structures, such as pantographs.

In accordance with the invention, it is furthermore also conceivable to provide just the first cladding part 1 as cladding arrangement and to embody this in the shape of a cuboidal envelope and arrange it around the running gear 5 to form the running gear hollow 19.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cladding arrangement comprising:

at least one first cladding part for a vehicle, said at least one cladding part having a longest extent oriented along a direction of travel and being connectable via at least one connecting device to one of (i) a running gear of the vehicle, (ii) a running gear component, iii a car body of the vehicle and iv a car body component; and at least one first heating device, which is directed into a running gear hollow formed by at least the first cladding part, connected to the at least first cladding part, said at least one first heating device being arranged along the longest extent of the at least one cladding in the direction of travel.

2. The cladding arrangement as claimed in claim 1, wherein the at least first heating device is formed as a film heater.

3. The cladding arrangement as claimed in claim 2, wherein the at least first heating device is connectable to a power supply facility of the vehicle.

4. The cladding arrangement as claimed in claim 2, wherein the at least first heating device is connectable to a power distribution facility of the running gear.

5. The cladding arrangement as claimed in claim 1, wherein the at least first heating device is connectable to a power supply facility of the vehicle.

6. The cladding arrangement as claimed in claim 5, wherein the at least first heating device is connectable to a power distribution facility of the running gear.

7. The cladding arrangement as claimed in claim 1, wherein the at least first heating device is connectable to a power distribution facility of the running gear.

8. The cladding arrangement as claimed in claim 1, wherein the at least first heating device is conformed to a geometric shape of the at least first cladding part.

9. The cladding arrangement as claimed in claim 1, wherein the at least first heating device includes a temperature sensor.

10. The cladding arrangement as claimed in claim 1, wherein the at least first heating device is connectable to a control unit of the vehicle.

11. The cladding arrangement as claimed in claim 1, wherein the at least first heating device is connectable to a data bus of the vehicle.

12. The cladding arrangement as claimed in claim 1, wherein the at least first heating device is connectable to a radio device.

13. The cladding arrangement as claimed in claim 1, wherein the at least first heating device is arranged in alignment with a vehicle component to be heated.

14. The cladding arrangement as claimed in claim 1, wherein the at least first heating device is integrated into the at least first cladding part.

15. The cladding arrangement as claimed in claim 1, wherein the vehicle is a rail vehicle.

16. A running gear having the cladding arrangement as claimed in claim 1.

17. A car body having the cladding arrangement as claimed in claim 1.

* * * * *